US008366801B2

(12) United States Patent
Chamberlain et al.

(10) Patent No.: US 8,366,801 B2
(45) Date of Patent: Feb. 5, 2013

(54) ATMOSPHERIC ACID LEACH PROCESS FOR LATERITES

(75) Inventors: Anthony Charles Chamberlain, Bicton (AU); Chad James Otto Czerny, Rankin Park (AU); Houyuan Liu, Henderson, NV (US); Harald Theowald Muller, Eleebana (AU)

(73) Assignee: BHP Billiton SSM Development Pty Ltd., Perth, Western Australia (AU)

( * ) Notice: Subject to any disclaimer, the term of this patent is extended or adjusted under 35 U.S.C. 154(b) by 142 days.

(21) Appl. No.: 12/672,351

(22) PCT Filed: Aug. 7, 2008

(86) PCT No.: PCT/AU2008/001144

§ 371 (c)(1),
(2), (4) Date: Dec. 30, 2010

(87) PCT Pub. No.: WO2009/018619

PCT Pub. Date: Feb. 12, 2009

(65) Prior Publication Data

US 2011/0100163 A1 May 5, 2011

(30) Foreign Application Priority Data

Aug. 7, 2007 (AU) ..... 2007904228

(51) Int. Cl.
*C22B 3/08* (2006.01)

(52) U.S. Cl. ..... 75/743; 423/150.1

(58) Field of Classification Search ..... 75/743; 423/150.1
See application file for complete search history.

(56) References Cited

U.S. PATENT DOCUMENTS 7,416,711 B2 * 8/2008 Liu et al. ..... 423/140
2005/0226797 A1 * 10/2005 Liu et al. ..... 423/150.1

FOREIGN PATENT DOCUMENTS

WO WO2001/032943 5/2001
WO WO2003/093517 11/2003
WO WO2006/069416 7/2006
WO WO2006/084335 8/2006

* cited by examiner

*Primary Examiner* — George Wyszomierski
*Assistant Examiner* — Tima M McGuthry Banks
(74) *Attorney, Agent, or Firm* — Brinks Hofer Gilson & Lione; G. Peter Nichols

(57) ABSTRACT

An atmospheric leach process for the recovery of nickel and cobalt from lateritic ores includes providing limonitic and saprolitic ore fractions of a laterite ore; separately slurrying the limonitic and saprolitic ore fractions to produce a limonitic ore slurry and a saprolitic ore slurry; separating any limonitic type minerals from the saprolitic ore slurry to produce a saprolitic feed slurry; milling or wet grinding the saprolitic feed slurry; leaching the limonitic ore slurry with concentrated sulfuric acid in a primary leach step; introducing the saprolitic feed slurry to the leach process in a secondary leach step by combining the saprolitic feed slurry with the leached limonite slurry following substantial completion of the primary leach step, and releasing sulfuric acid to assist in leaching the saprolite feed slurry.

21 Claims, 1 Drawing Sheet

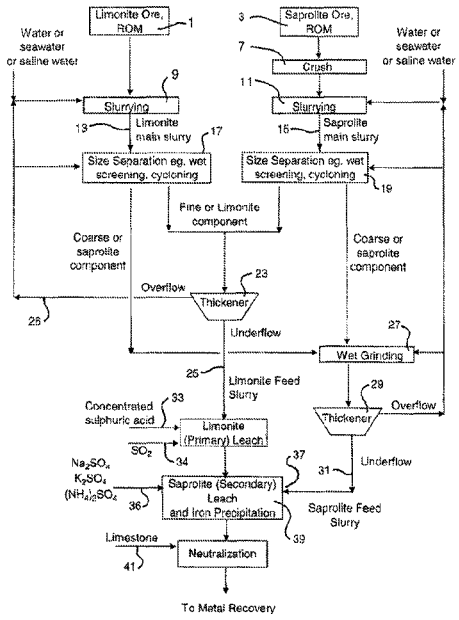

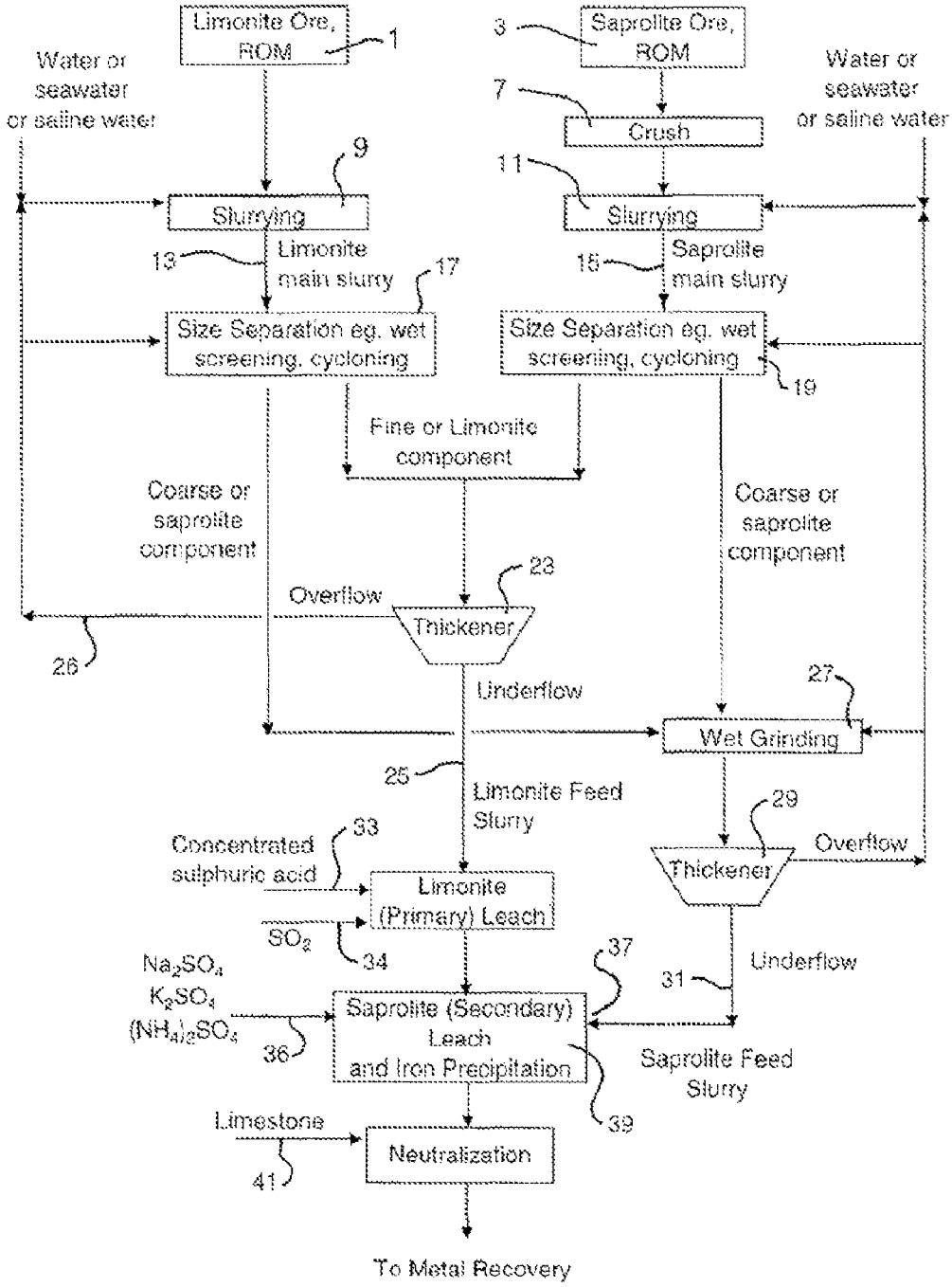
Limonite Ore, ROM
1
Water or seawater or saline water
Saprolite Ore, ROM
3
Water or seawater or saline water
7
Crush
9
Slurrying
11
Slurrying
13
Limonite main slurry
17
15
Saprolite main slurry
Size Separation eg. wet screening, cycloning
Size Separation eg. wet screening, cycloning
19
Fine or Limonite component
Coarse or saprolite component
Coarse or saprolite component
23
Overflow
Thickener
26
Underflow
27
Wet Grinding
25
Limonite Feed Slurry
29
Overflow
Thickener
33
Concentrated sulphuric acid
Limonite (Primary) Leach
$SO_2$
34
37
Underflow
31
$Na_2SO_4$
$K_2SO_4$
$(NH_4)_2SO_4$
36
Saprolite (Secondary) Leach and Iron Precipitation
Saprolite Feed Slurry
39
Limestone
41
Neutralization
To Metal Recovery

ATMOSPHERIC ACID LEACH PROCESS FOR LATERITES

This application claims priority to PCT Application Serial No. PCT/AU2008/001144 filed Aug. 7, 2008 published in English on Feb. 12, 2009 as PCT WO 2009/018619 and also to Australian Application No. 2007/904228 filed Aug. 7, 2007, the entire contents of each are incorporated herein by reference.

FIELD OF THE INVENTION

The present invention resides in a process for the atmospheric pressure acid leaching of laterite ores to recover nickel and cobalt products.

More specifically, the invention resides in the sequential and joint acid leaching of laterite ore fractions to recover nickel and cobalt, and discard the iron residue material. The process of the present invention is particularly applicable to processing the whole laterite ore body, that is both the limonite and saprolite fractions in sequential reactions by first leaching the limonite ore fraction with sulfuric acid at atmospheric pressure and temperatures up to the boiling point, sequentially followed by the leaching of the saprolite ore fraction where substantially all the limonitic type minerals had been removed from the saprolite before leaching.

The process is particularly applicable to processing a laterite ore body where the limonite ore fraction includes a high iron content and the saprolite fraction includes a high goethite content.

BACKGROUND

A laterite (nickeliferous) ore body essentially contains three fractions: the limonite fraction beneath surface soil, the saprolite fraction above the bed rock, and ores in the transitional zone between limonite and saprolite. The nickel-containing mineral in limonite is goethite and/or hematite, which are soft and fine in particle size. The nickel-containing minerals in saprolite are mostly coarse siliceous phases such as serpentine, garnierite, chlorite, nontronite, and smectite. The ore in transition zone contains both limonite and saprolite. With the aid of geological data and mining program, it is possible to separate limonite and saprolite via screening with designed cut-off particle size. However, in mining practice, it is difficult to have a clean separation of limonite and saprolite fractions. Consequently, the cross-entrainment of limonite and saprolite exists to a certain extent with the run-of-mine saprolite and limonite fractions.

PCT/AUO3/00309 (H. Liu et al, QNI Technology PTY LTD) describes an Atmospheric Acid Leach (AAL) process that processes the whole laterite ore deposit across the three ore zones. In the process described the limonite slurry (or the low Mg containing fraction) was mixed and leached with concentrated acid at temperatures up to 105° C. (or the boiling point at atmospheric pressure). The iron content in the tested limonite in the Examples of this application was generally from 40-43%, and the dose of sulfuric acid, in terms of the weight ratio of sulfuric acid to dry limonite ore, was 1.32 to 1.43. This is shown in each of the eleven Examples. At the equilibrium acidity of 0-10 g/L to form goethite, the saprolite (or the high Mg containing fraction) used showed good leaching reactivity and neutralization capacity. This was due to the fact that it was not significantly contaminated with limonite.

The mineralogy of laterite ore components varies depending upon from which region the ore is sourced. Table 1, in PCT/AU03/00309 shows the characterisation of various laterite ore bodies from different parts of the world. The ore which is used in the Examples of PCT/AU03/00309 was sourced from Gag Island, Indonesia. Because of the wide characterisation of different laterite ore bodies, the process to recover the nickel and cobalt from within the ore body must be tailored to maximise the recovery.

The Applicants have found that with a laterite ore body with high iron content, particularly a high iron content in the limonite fraction and a high goethite and/or hematite content in the saprolite fraction, the nickel recovery is compromised in an atmospheric leach process as the saprolite fraction has less leaching reactivity and neutralisation capacity. This is thought to be due to a higher goethite or hematite content in the saprolite fraction.

The present invention aims to overcome or alleviate some of the problems that may occur when processing a high iron content laterite under atmospheric pressure conditions.

A reference herein to a patent document or other matter which is given as prior art is not to be taken as an admission that that document or matter was known or that the information it contains was part of the common general knowledge as at the priority date of any of the claims.

SUMMARY OF THE INVENTION

The present invention resides in a process for the atmospheric acid leaching of laterite ores to recover nickel and cobalt products. In particular, the present invention resides in the atmospheric acid leaching of both the limonitic and saprolitic fractions of the lateritic ore sequentially and jointly to recover nickel and cobalt at atmospheric pressure and temperatures up to the boiling point of the acid. The laterite ore may also be inclusive of other ore types, such as smectite, nontronite and serpentine ore fractions, and it is to be considered that they are processed together with, and in the manner in which the limonite and saprolite fractions are processed in the process described herein.

The present invention is particularly applicable to processes where the ore is particularly high in iron content and includes an amount of transitional ore where it has been difficult to separate the limonite and saprolite components by selective mining or post mining classification, or the nature of the deposit does not allow for easy post mining separation. The process of the invention may also be applied to the processing of ores where the limonite and saprolite have been sourced from different ore deposits.

Accordingly, the present invention resides in an atmospheric leach process in the recovery of nickel and cobalt from lateritic ores, said process including the steps of:

a) providing limonitic and saprolitic ore fractions of a laterite ore;
b) separately slurrying the limonitic and saprolitic ore fractions to produce a limonitic ore slurry and a saprolitic ore slurry;
c) separating any limonitic type minerals from the saprolitic ore slurry to produce a saprolitic feed slurry;
d) milling or wet grinding the saprolitic feed slurry;
e) leaching the limonitic ore slurry with concentrated sulfuric acid in a primary leach step;
f) introducing the saprolitic feed slurry to the leach process in a secondary leach step by combining the saprolitic feed slurry with the leached limonite slurry following substantial completion of the primary leach step, releasing sulfuric acid to assist in leaching the saprolite feed slurry;

wherein the saprolitic feed slurry is substantially free of all limonitic type minerals before it is introduced to the leach process.

As the whole ore body is being processed, the post classification limonite ore will generally consist of the fine particle size nickel containing minerals such as goethite and/or hematite, but will also include some coarse saprolite rich siliceous components such as serpentine, garnierite, chlorite, nontronite and smectite. Similarly, the saprolite fraction will contain not only the saprolitic components, but some fine limonite rich particle material enriched with goethite and/or hematite. In fact, this process is applicable to processing lateritic ore, where the saprolite fraction may be contaminated with greater than 30 wt % goethite. The applicants have found in particular that where the saprolite ore has a relatively high goethite content, the nickel in the goethite cannot be sufficiently extracted, as the acidity during the secondary leach step is not strong enough to break down the goethite structure.

Goethite is the major nickel containing mineral phase in most laterite samples, however some laterite ore bodies do have minor quantities of nickel containing hematite minerals.

Accordingly, in a preferred embodiment of the invention, the limonitic type minerals such as the fine particle size iron rich oxide materials such as goethite and/or hematite, are removed from the saprolite ore slurry by wet screening, cycloning or classification, before the saprolitic ore slurry is added to the secondary leach step.

The saprolitic type minerals such as the coarse siliceous components serpentine, garnierite, chlorite, nontronite and smectite may also be removed from the limonite ore slurry by wet screening, cycloning or classification prior to the primary leach step. However it has been found that it is the removal of substantially all the limonite type minerals from the saprolitic ore slurry before leaching that has lead to an improvement in overall nickel and cobalt recovery.

DETAILED DESCRIPTION OF THE INVENTION

The process of the present invention involves first separating the lateritic ore into its limonite fraction and saprolite fraction by selective or post mining classification. Alternatively, the limonite and saprolite fractions may be provided from separate locations.

Depending on ore type, both the limonite and saprolite fractions contain at least to some extent, a fine and coarse component. This is generally due to incomplete separation of the limonite and saprolite fraction during post mining classification. The fine component generally consists of the limonitic type ore components such as goethite and/or hematite. The nickel is entrained inside within the goethite and/or hematite mineral structures. The coarse component generally consists of the saprolitic type ore components such as the coarse siliceous serpentine, nontronite and smectite minerals.

In one embodiment, the process of the present invention involves classifying the lateritic run of mine ore into its limonite and saprolite fractions. This is generally achieved through selective mining or post mining classification including selective screening. The process is particularly applicable to ore bodies where it is difficult or not opportune to cleanly separate the limonite and saprolite fractions, and/or generally where each of the limonite and saprolite fractions have significant quantities of fine and coarse components within them. The process is also applicable to laterite ore bodies that have a high iron content, for example where the saprolite fraction may have greater than about 30% goethite and/or hematite while the limonite fraction may have greater than 85% goethite and/or hematite, or greater than 45% iron content.

Following post mining classification, both the limonite and the saprolite fractions are separately slurried. Generally, the slurry will be formed using fresh water, or at least water which is substantially free of sodium, alkaline metal or ammonium ions, but may be slurried using saline or seawater. It has been found that both the resultant limonite and saprolite slurries will have, to some extent, a fine limonite rich and coarse saprolite rich component.

In the primary leach step, the limonite feed slurry is leached with concentrated sulfuric acid in a first reactor or series of reactors. This is generally done at a temperature up to 105° C. or the boiling point of the leach reactants at atmospheric pressure.

The limonite ore slurry may have undergone size separation prior to the primary leach step to recover the saprolitic type minerals that may be present in the slurry. This helps to reduce acid consumption and improve nickel extraction.

Most preferably the reaction temperature in the primary leach step is as high as possible to achieve rapid leaching at atmospheric pressure. The nickel containing mineral in limonite ore is goethite and/or hematite, and the nickel is distributed in the goethite or hematite matrix. The acidity of the primary leach step therefore should be sufficient to destroy the goethite/hematite matrix to liberate the nickel. The dose of sulfuric acid is preferably 100 to 140% of the stoichiometric amount to dissolve approximately over 90% of nickel, cobalt, iron, manganese and over 80% of the aluminium and magnesium in the ore. The weight ratio of acid to limonite ore in the primary leach step is preferably in the range of from 1:30 to 1:65, depending on the relative iron and magnesium contents, and expected metal extractions.

In order to liberate the cobalt content of asbolane, or other similar Mn (III or IV) minerals, a reductant, eg sulfur dioxide gas, lithium metabisulfite or sulfite, is injected into the limonite feed slurry to control the redox potential to preferably less than 1000 mV (SHE), to improve cobalt recovery, and preferably above 800 mV (SHE), to minimize ferrous ion formation. Most preferably the redox potential is controlled to be about 835 mV (SHE) for the primary leach step. At about 835 mV (SHE), cobalt is almost completely released from the asbolane while almost no ferric ion ($Fe^{3+}$) is reduced to the ferrous ion ($Fe^{2+}$).

Once the primary leach step is substantially complete, the saprolite feed slurry is introduced to the secondary leach step by combining the saprolite feed slurry with the leached limonite slurry.

Prior to the secondary leach step the saprolite ore slurry should undergo size separation to remove the fine iron rich goethite and hematite phases from the coarse saprolite silicate rich minerals. If any limonitic type minerals are not separated from the saprolitic type ore, then the iron rich goethite and hematite mineral phases will not be completely leached in the secondary leach step resulting in poor overall nickel extraction. Separation of the limonitic type minerals from the saprolitic type ore, is generally achieved by size separation by various methods such as wet screening, cycloning or classification.

It is preferable that milling or wet grinding of the saprolitic ore slurry is performed after the size separation steps to maximise separation efficiency. The saprolitic type ore slurry is preferably ground to a particle size less than 300 microns. It has been found that grinding does enhance the leaching kinetics and increase the liberation of nickel containing minerals to the lixiviant. The coarse saprolite components are preferably ground by milling or wet grinding prior to the secondary leach step.

The solid concentration in both the limonite and saprolite feed slurries for the primary and secondary leach respectively, is preferably within the range of 20% to 40% solid content, depending on the slurry rheology and expected composition of the leach product solution. Tests have shown that a solid concentration of about 25-30% in both the limonite and saprolite slurries is most preferred.

Theoretically, the amount of saprolite added during the secondary leach step should be approximately equivalent to the sum of the residual free acid in the primary leach step, and the acid released from the iron precipitation as goethite. For instance about 20-30 g/L of residual free acid remains from the primary leach step while 210-260 g/L sulfuric acid (equivalent to 80-100 g/L. $Fe^{3+}$) is released during goethite precipitation. Additional acid can be added to the secondary leach step, if a larger disproportionate amount of saprolite slurry is available.

During the secondary leach step the redox potential is preferably controlled to be between 700 and 900 mV (SHE), most preferably about 720 and 800 mV (SHE). The preferred redox potential in the secondary leach step is slightly less than that of the primary leach step because saprolite contains ferrous ion and the release of ferrous ions decreases the redox potential in the secondary leach step. Therefore, generally no reductant is needed to control the redox potential in this stage of the process. The need for a reductant during the secondary leach step is largely dependant on the content of the saprolite ore and some reductant may be required if, for example, there is a high content of cobalt in asbolane or some oxidant, such as dichromate, is present during the saprolite leach.

The completion of reduction and leaching following the secondary leach step is indicated by the formation of typically 0.5 to 3.0 g/L ferrous ion ($Fe^{2+}$) and steady acid concentration under these reaction conditions. The weight loss of limonite ore is typically over 80% and the extraction of nickel and cobalt is over 90%.

The secondary leach step includes the simultaneous leaching of the saprolite ore and iron precipitation, preferably as goethite, jarosite or other relatively low sulfate-containing forms of iron oxide, ferrihydrite or iron hydroxide.

The secondary leach step is generally carried out in a separate reactor or series of reactors from that of the primary leach step. The saprolite feed slurry, (which may optionally be preheated) and the leached limonite slurry after completion of the primary leach step, are added to the reactor of the secondary leach step. The reaction is carried out at the highest possible temperature preferably up to 105° C., or the boiling point of the leach reactants at atmospheric pressure. The reaction temperature is most preferably as high as possible to achieve rapid leaching and iron precipitation kinetics.

The present invention also resides in the recovery of nickel and cobalt following the leaching stage. The leach solution, which may still contain a proportion of the ore iron content as ferric iron after the second leach step, can be prepared for nickel recovery by a number of means, which include the following.

Firstly excess ferric iron remaining in solution at the end of the secondary leaching stage can be precipitated as jarosite by adding a jarosite-forming ion, eg $Na^+$, $K^+$, $NH^+_4$, and jarosite seed material to the leach slurry. The jarosite forming ion may be added as sodium sulfate, potassium sulfate or ammonium sulfate, or may be present in seawater or brine that has been used during the slurry preparation or leach process. In this case, the additional acid liberated during jarosite precipitation can be used to leach additional saprolite ore.

Alternatively, neutralisation with limestone slurry to force iron precipitation as goethite substantially to completion may be employed. The end point of neutralisation is in the pH range 1.5 to 3.0, as measured at ambient temperature.

In a further alternative, excess ferric iron can be reduced to the ferrous state with a reductant such as sulfur dioxide, as shown in the following reaction:

$$Fe_2(SO_4)_3+SO_2+2H_2O=2FeSO_4+2H_2SO_4 \quad (1)$$

Reaction (1) also generates additional sulfuric acid that can be used to leach additional saprolitic feed slurry. Nickel and cobalt can be recovered from the resulting solution by, for example, sulfide precipitation using hydrogen sulfide or another sulfide source. Ferrous ions will not interfere with this process and will not contaminate the sulfide precipitate. Alternatively mixed hydroxide precipitation, ion exchange or liquid-liquid solvent extraction can be used to separate the nickel and cobalt from the ferrous iron and other impurities in the leach solution. It will be clear to those skilled in the art that other process options for completing the separation of nickel and cobalt from iron in solution may be employed.

Preferably, the iron is precipitated as goethite or another relatively low sulfate containing form of iron oxide or iron hydroxide, which contain little or no sulfate moieties. Generally, this is achieved when fresh water is used, or water at least which is low in sodium, alkaline metal and ammonium ion content. The general reaction when goethite is precipitated is expressed in reaction (2):

$$(Fe,Ni,)O.OH+(Mg,Ni)_3Si_2O_5(OH)_4+H_2SO_4 \rightarrow FeO.OH+NiSO_4+MgSO_4+SiO_2+H_2O \quad (2)$$

This general reaction is a combination of the primary limonite leach step and the secondary saprolite leach step.

Similarly, the general reaction with iron precipitation as jarosite is expressed in reaction (3):

$$(Fe,Ni)O.OH+(Mg,Ni)_3Si_2O_5(OH)_4+H_2SO_4 \rightarrow NaFe_3(SO_4)_2(OH)_6+NiSO_4+MgSO_4+SiO_2+H_2O \quad (3)$$

In the removal of iron as jarosite from the reaction mixture, one mole of acid is produced per mole of iron precipitated. However when the iron is precipitated as goethite, 1.5 mole of acid is produced per mole of iron precipitated. Generally however, when seawater or a saline solution is used, the iron would be precipitated as jarosite.

During the secondary leach step, the iron is most preferably precipitated as goethite, that is FeO(OH), which results in a higher level of acid being available for the secondary leach step than if the iron was precipitated as, for example, jarosite. A particular feature of the process of the present invention is that as sulfuric acid, is released during iron precipitation of the secondary leach step, there is, in general, no need for additional sulfuric acid to be added during this step.

BRIEF DESCRIPTION OF THE DRAWING

FIG. 1 shows a flowsheet for the proposed process in accordance with the present invention.

DETAILED DESCRIPTION OF THE DRAWING

FIG. 1 illustrates a flowsheet of a preferred embodiment of the process of the invention. It should be kept in mind that description of this flowsheet is intended to describe a preferred embodiment of the invention, and the scope of the invention should not be considered to be limited thereto.

The run of mine saprolite ore (3) is crushed (7). The run of mine limonite ore (1) and crushed saprolite (7) are slurried (9) and (11) using either fresh water, seawater or saline water to form the limonite (13) and saprolite (15) slurries.

The limonite and saprolite slurry each includes both fine and coarse components. The fine component predominantly consists of limonitic ore, where the nickel is contained in goethite and/or hematite. The coarse component essentially consists of saprolitic ore which is predominantly made up of silicate minerals including serpentine, garnierite, chlorite, nontronite and smectite minerals. The coarse and fine components are separated from both the limonite and saprolite slurries (17 and 19 respectively) by wet screening, cycloning or classification, to produce a fine limonite slurry, which is essentially free of saprolitic type minerals, and a coarse saprolite slurry which is essentially free of limonitic type minerals.

In another embodiment, the saprolite slurry is subjected to size separation by wet screening, cycloning or classification, to separate out the limonitic type minerals, which are then combined with the limonite slurry. The limonitic slurry itself may not undergo a size separation step to separate the saprolitic type minerals from the limonite slurry.

The fine limonitic type minerals from the saprolite slurry are combined with the limonite slurry or the limonitic type minerals that may have been separated from the limonitic slurry, thickened (23) and the underflow forms a limonite (primary leach) feed slurry (25). The overflow (26) may be recycled to either the slurrying step (9), the separation step (17) or both.

The coarse saprolite components are combined and wet ground (27) and thickened (29) and the underflow forms a saprolite (secondary leach) feed slurry (31). The overflow (28) may be recycled to one or more of the slurrying step (11), the separation step (19) or the wet grinding step (20).

The limonite feed slurry (25) is leached with a concentrated sulfuric acid (33) and sulphur dioxide gas (34) in a primary leach step (35). The sulfur dioxide gas is used as a reductant to maintain the redox potential of the primary leach step within the desired range of from 800 mV (SHE) to 1000 mV (SHE).

When the primary leach step is nearing completion or completed, the saprolite feed slurry (31) is combined with the leached limonite slurry in a secondary leach step (37). A source of monovalent cations such as sodium sulfate, potassium sulfate and ammonium sulfate may be added in the secondary leach stage to assist with jarosite precipitation (36). Iron is precipitated generally as goethite, jarosite or hematite (39).

The resultant leach solution is neutralised using limestone (41) leading to nickel and cobalt recovery. Preferably but not essentially the limestone slurry may be heated to increase the reactivity of neutralisation.

EXAMPLES

Example 1

A lateritic ore sample was sourced from Indonesia and used in this Example (the "Indonesian" sample). The limonite fraction from this Indonesian sample had an iron content of 49%. Mineralogy characterization indicates that the goethite content in the limonite fraction and the saprolite fraction was 92% and 35% respectively. It was found that the saprolite sample had less leaching reactivity and neutralization capacity than a laterite sample from Gag Island which was used in the Examples of PCT/AUO3/00309 (the "Gag Island" sample).

Atmospheric acid leach amenability tests were performed on the Indonesian sample ores. The results show that nickel recovery from the limonite fraction of the Indonesian sample meets expectation, whereas Ni recovery from saprolite fraction was low. The low reactivity was caused by the Indonesian sample's high goethite content (35%) in the saprolite fraction, which was not reactive during the secondary leach step. Therefore, nickel embedded in goethite cannot be sufficiently extracted. About 98.7% nickel was extracted from the limonite fraction after 3 hours limonite leach. However, only 54.2% nickel was recovered from the saprolite fraction after 11 hours saprolite leach. The overall nickel extraction rate was 68%.

TABLE 1

Average Chemical Composition (% wt) of Gag Island and Indonesian Laterite Samples

| | | Co % | Fe % | Mg % | Ni % |
|---|---|---|---|---|---|
| Limonite | Gag Island | 0.09 | 41.49 | 1.38 | 1.54 |
| | Indonesian samples | 0.11 | 48.70 | 0.80 | 1.65 |
| Saprolite | Gag Island | 0.04 | 11.31 | 14.33 | 2.72 |
| | Indonesian Samples | 0.03 | 11.70 | 16.10 | 3.12 |

TABLE 2

Mineral Constitution* (% wt) of Gag Island and Indonesian Laterite Samples

| | | Goethite | Spinel | Mg silicate** | SiO2 |
|---|---|---|---|---|---|
| Limonite | Gag Island | 46.5 | 1.5 | 19.15 | 21.3 |
| | Indonesian Samples | 92.0 | 3.0 | n.a. | 5.0 |
| Saprolite | Gag Island | 15.9 | 0.5 | 57.9 | 18.8 |
| | Indonesian Samples | 35.0 | n.a. | 47 | 23.57 |

*With XRD assay

**Include serpentine, enstatite and forsterite

Modified Atmospheric Acid Leach (AAL) Process to Treat Laterite Ore Samples

Controlled Acid Dosing and Solid Concentration of the Starting Materials

Due to high iron content in the limonite fraction of the Indonesian sample, it was found that the sulfuric acid doses used in Examples of PCT/AU03/00309 were not enough to destroy the goethite crystal lattice to liberate embedded nickel. The acid dose of limonite leach i.e. the weight ratio of acid/limonite was raised from 1.35-1.40 to 1.60. Table 3 illustrates the improvement of the overall nickel extraction and the nickel extraction of the limonite and saprolite fractions.

TABLE 3

Nickel Extraction with Various Acid Doses

| Test ID | Acid/Limonite t/t | Overall Ni Extraction % | Limonite Extraction % | Saprolite Extraction % |
|---|---|---|---|---|
| 1-1 | 1.30 | 56.0 | 90.0 | 38.0 |
| 1-2 | 1.44 | 58.0 | 91.0 | 41.0 |
| 2-1 | 1.55 | 67.5 | 98.0 | 52.3 |
| 2-2 | 1.60 | 68.5 | 98.7 | 54.5 |

Note:

30% limonite and saprolite slurry were used in tests 1-1 and 1-2

24% limonite and saprolite slurry were used in tests 2-1 and 2-2.

Although increase in the solid concentration of starting materials can decrease the reactor size and increase the nickel and cobalt concentration of the PLS, overly concentrated feed slurry can also render saturation of Fe ions in the leach solution. No more goethite will be able to dissolve once the Fe concentration in liquor reaches its saturation level. The atmospheric acid leach results on the Indonesian sample ore show that Fe supersaturated at ~150 g/L after 3 hours limonite leach (when input slurry was 30% in solid concentration). Table 3 shows that lowering solid concentration of the starting materials from 30% to 24% promoted the ore leaching process and consequently improved the nickel extraction rate.

Example 2

Ore processing of an Indonesian laterite ore was performed by wet screening to treat the limonite and saprolite fractions, respectively. The screen size was 355 micron. The under screen fractions were combined as limonitic ore feeding for AAL and the over screen fractions were combined as saprolitic ore feeding for AAL. Table 4 illustrates the up-grade results of limonitic and saprolitic ore based on nickel, iron, magnesium and silicon contents at a separation size of 355 micron.

TABLE 4

Up-graded Limonite and Saprolite Compositions (%)
Wet Screen Size: 355 micron

| | Fraction | Si % | Fe % | Mg % | Ni % |
|---|---|---|---|---|---|
| Indonesian Limonite | Bulk ore | 1.3 | 48.7 | 0.8 | 1.65 |
| | Over size | 0.9 | 29.9 | 4.2 | 0.51 |
| | Under size | 1.3 | 50.0 | 0.3 | 1.70 |
| Indonesian Saprolite | Bulk ore | 19.2 | 11.7 | 16.1 | 3.12 |
| | Over size | 20.8 | 8.9 | 18.1 | 4.06 |
| | Under size | 15.4 | 23.1 | 9.9 | 2.95 |

Example 3

Ore processing by size separation was performed on an Indonesian laterite ore to variously treat the saprolite fraction. Tables 5 to 7 illustrate the up-grade results of saprolitic ore obtained, based on nickel, iron, magnesium and silicon contents at separation sizes of 100, 63 and 45 micron, respectively.

TABLE 5

Up-graded Saprolite Compositions (%)
At Separation Size: 100 micron

| | Fraction | Mass % | Si % | Fe % | Mg % | Ni % |
|---|---|---|---|---|---|---|
| Indonesian Saprolite | Bulk ore | 100 | 19.3 | 11.7 | 16.0 | 3.15 |
| | Over size | 74.4 | 20.9 | 7.7 | 18.8 | 2.79 |
| | Under size | 25.6 | 14.6 | 23.3 | 9.2 | 4.22 |

TABLE 6

Up-graded Saprolite Compositions (%)
At Separation Size: 63 micron

| | Fraction | Mass % | Si % | Fe % | Mg % | Ni % |
|---|---|---|---|---|---|---|
| Indonesian Saprolite | Bulk ore | 100 | 19.3 | 11.7 | 16.0 | 3.15 |
| | Over size | 76.8 | 20.8 | 7.9 | 18.2 | 2.82 |
| | Under size | 23.2 | 14.3 | 24.2 | 8.8 | 4.28 |

TABLE 7

Up-graded Saprolite Compositions (%)
At Separation Size: 45 micron

| | Fraction | Mass % | Si % | Fe % | Mg % | Ni % |
|---|---|---|---|---|---|---|
| Indonesian Saprolite | Bulk ore | 100 | 19.3 | 11.7 | 16.0 | 3.15 |
| | Over size | 78.3 | 20.7 | 8.1 | 18.1 | 2.83 |
| | Under size | 21.7 | 14.1 | 24.7 | 8.6 | 4.31 |

Example 4

Ore processing was performed on a Philippines laterite ore to treat the limonite and saprolitic fractions. The average composition of the limonite fraction after treatment was 1.17% Ni, 42.3% Fe, 1.26% Mg, 5.5% Al and 3.47% Si. The saprolite fraction was treated by wet screening at a separation size of 45 micron. Table 8 shows the up-grade results obtained on the saprolitic (oversize) fraction, based on the nickel, iron, magnesium and silicon contents.

TABLE 8

Up-graded Saprolite Compositions (%)
At Separation Size: 45 micron

| | Fraction | Si % | Fe % | Mg % | Ni % |
|---|---|---|---|---|---|
| Philippines Saprolite | Bulk ore | 17.0 | 18.6 | 13.3 | 1.33 |
| | Over size | 19.6 | 10.2 | 18.3 | 0.95 |

Atmospheric acid leach amenability tests were performed on the Philippines laterite ores slurried in tap (potable) water and thickened to obtain a solids content of 25 to 28% w/w. The results shown in Table 8 illustrate that nickel recovery from the limonite fraction met expectations, whereas the nickel extraction from the saprolite fraction without size separation was low. The low reactivity was caused by the high goethite content in the saprolite fraction, which was not reactive during the secondary leach step. Following size separation to remove the fine (−45 micron) limonite component, nickel extraction from saprolite (oversize) and overall nickel extraction were both significantly improved. Table 9 illustrates the reduction in the iron concentration of the final product solution obtained by leaching following removal of the limonite fines component.

TABLE 9

Nickel Extraction from Philippines Laterite Ores Slurried in Tap Water

| Test ID | Saprolite Ore | Acid/ Limonite t/t | Overall Ni Extraction % | Limonite Ni Extraction % | Saprolite Ni Extraction % |
|---|---|---|---|---|---|
| 3-1 | Bulk | 1.46 | 73.4 | 94.9 | 54.1 |
| 3-2 | Oversize | 1.38 | 84.1 | 97.1 | 64.6 |

TABLE 10

Average Composition (g/L) of Product Solution obtained from Atmospheric Leaching of Philippines Laterite Ores

| Test ID | Saprolite Ore | Acid/Limonite t/t | Fe(total) g/L | $Fe^{3+}$ g/L | pH |
|---|---|---|---|---|---|
| 3-1 | Bulk | 1.46 | 39 | 34 | 1.2 |
| 3-2 | Oversize | 1.38 | 24 | 20 | 1.5 |

The description of the invention described herein is intended to describe the features that characterise the invention. Modification to those features that do not depart from the spirit or ambit of the invention described herein are to be included within the scope of the invention.

The invention claimed is:

1. An atmospheric leach process in the recovery of nickel and cobalt from lateritic ores, said process including the steps of:

a. providing limonitic and saprolitic ore fractions of a laterite ore;

b. separately slurrying the limonitic and saprolitic ore fractions to produce a limonitic ore slurry and a saprolitic ore slurry;

c. separating limonitic minerals from the saprolitic ore slurry to produce a saprolitic feed slurry;

d. milling or wet grinding the saprolitic feed slurry;

e. leaching the limonitic ore slurry with concentrated sulfuric acid in a primary leach step;

f. introducing the saprolitic feed slurry from step (d) in a secondary leach step by combining the saprolitic feed slurry from step (d) with the leached limonite slurry following substantial completion of the primary leach step, releasing sulfuric acid to assist in leaching the saprolite feed slurry, wherein the saprolitic feed slurry is substantially free of all limonitic minerals before it is introduced to the leach process.

2. A process according to claim 1 wherein the limonitic minerals are separated from the saprolitic ore slurry by wet screening, cycloning or classification.

3. A process according to claim 1 wherein any coarse saprolitic minerals are separated from the limonitic ore slurry prior to the primary leach step.

4. A process according to claim 3 wherein the coarse saprolitic minerals are separated from the limonitic ore slurry by wet screening, cycloning or classification.

5. A process according to claim 1 wherein saprolitic components in the saprolitic feed slurry are ground to a particle size of less than 300 microns.

6. A process according to claim 1 wherein iron is precipitated as goethite, ferrihydrite, jarosite or another relatively low sulfate containing form of iron oxide, ferrihydrite or iron hydroxide following the addition of the saprolitic feed slurry during the secondary leach step.

7. A process according to claim 1 wherein the limonitic minerals are selected from the group consisting of nickel containing iron-rich oxide material, goethite and hematite.

8. A process according to claim 1 wherein the solid concentration in the limonite and saprolite feed slurries is from about 20% to about 40% solid content.

9. A process according to claim 1 wherein the saprolite minerals include coarse siliceous components selected from the group consisting of serpentine, garnierite, chlorite, nontronite and smectite.

10. A process according to claim 1 wherein the weight ratio of acid to limonite ore in the primary leach step is in the range of from 1:30 to 1:65.

11. A process according to claim 1 wherein the primary leach step is carried out in a first reactor or series of reactors at a temperature of up to 105° C. or the boiling point of the leach reactants at atmospheric pressure.

12. A process according to claim 1 wherein the sulfuric acid added in the primary leach step is from about 100 to about 140% of a stoichiometric amount needed to dissolve approximately over about 90% of nickel, cobalt, iron, manganese and over about 80% of aluminum and magnesium in the ore.

13. A process according to claim 1 wherein the secondary leach step takes place in a separate reactor or reactors from the primary leach step, and at a temperature of up to 105° C. or the boiling point of the leach reactants at atmospheric pressure.

14. A process according to claim 1 wherein sulfuric acid is added to the secondary leach to supplement the sulfuric acid released following the addition of the saprolitic feed slurry.

15. A process according to claim 1 wherein a redox potential during the primary leach step is controlled to below 1000 mV standard hydrogen electrode (SHE) to improve cobalt recovery.

16. A process according to claim 15, wherein the redox potential is controlled by injecting either sulfur dioxide gas, lithium metabisulfite or sulfite into the slurry.

17. A process according to claim 1 wherein a redox potential during the primary leach step is controlled to be above 800 mV standard hydrogen electrode (SHE) to minimize ferrous ion formation.

18. A process according to claim 1 wherein the a redox potential in the secondary leach step is maintained between 700 mV and 900 mV standard hydrogen electrode (SHE).

19. A process according to claim 18 wherein the redox potential is controlled by injecting either sulfur dioxide gas, lithium metabisulfite or sulfite into the slurry.

20. A process according to claim 1 wherein a monovalent cation is added to the secondary leach step to precipitate iron as jarosite.

21. A process according to claim 20 wherein the monovalent cation is selected from sodium, potassium and ammonium.

* * * * *